US007678209B2

(12) United States Patent
Koch

(10) Patent No.: US 7,678,209 B2
(45) Date of Patent: Mar. 16, 2010

(54) ENERGY-PRODUCING MATERIAL

(75) Inventor: Ernst-Christian Koch, Kaiserslautern (DE)

(73) Assignee: Diehl BGT Defence GmbH & Co., KG, Ueberlingen (DE)

( * ) Notice: Subject to any disclaimer, the term of this patent is extended or adjusted under 35 U.S.C. 154(b) by 738 days.

(21) Appl. No.: 11/497,791

(22) Filed: Aug. 2, 2006

(65) Prior Publication Data

US 2010/0036086 A1 Feb. 11, 2010

(30) Foreign Application Priority Data

Aug. 18, 2005 (DE) ..... 10 2005 038986

(51) Int. Cl.

| | |
|---|---|
| ***C06B 33/00*** | (2006.01) |
| ***C06B 33/02*** | (2006.01) |
| ***D03D 23/00*** | (2006.01) |
| ***D03D 43/00*** | (2006.01) |

(52) U.S. Cl. ..... 149/37; 149/44; 149/109.4

(58) Field of Classification Search ..... 149/37, 149/44, 109.4

See application file for complete search history.

(56) References Cited

U.S. PATENT DOCUMENTS

| | | | |
|---|---|---|---|
| 3,071,617 | A | 1/1963 | Hass |
| 4,988,397 | A | 1/1991 | Adolph et al. |
| 5,574,248 | A | 11/1996 | Brown et al. |
| 5,886,293 | A | 3/1999 | Nauflett et al. |

FOREIGN PATENT DOCUMENTS

| | | |
|---|---|---|
| GB | 2 269 380 | 2/1994 |
| GB | 2 291 642 | 1/1996 |

OTHER PUBLICATIONS

Milton R. Smith, Jr. et al., "Preparation of α,ω-bis(dimethylhydrosilyl)perfluorohexane", Journal of Organometallic Chemistry (1972), vol. 46, pp. 251-254.

S.S. Dua, et al., "Some Perfluoroalkyl Grignard Reagents and Their Derivatives", Journal of Fluorine Chemistry (1974), vol. 4, pp. 409-413.

Ch. Elschenbroich et al., Organometallchemie, 3 Aufl., Teubner Verlag, Stuttgart (1990), p. 246.

Ch. Elschenbroich et al., Organometallchemie, 3 Aufl., Teubner Verlag, Stuttgart (1990), p. 55.

Larry Sotsky et al., "Twin Screw Mixing/Extrusion of M206 Infrared (IR) Decoy Flare Composition", 33rd Int. Conference of ICT, Jun. 25-28, 2002, V35.

Chris van Driel et al., "Ageing of MTV", 26th Int. Conference of ICT, Jul. 4-7, 1995, V31.

"Cellulosenitrat", http://de.wikipedia.org: pp. 1-4.

*Primary Examiner*—Jerry Lorengo
*Assistant Examiner*—James E McDonough
(74) *Attorney, Agent, or Firm*—Scully, Scott, Murphy & Presser, P.C.

(57) ABSTRACT

An energy-producing material which comprises a chemically uniform polymer material whose monomer units contain an electron donor and an electron acceptor, wherein the stoichiometric ratio of electron donor to electron acceptor is ≦1, is proposed.

2 Claims, No Drawings

ENERGY-PRODUCING MATERIAL

The present invention relates to an energy-producing material for civil and military applications, for example igniters for gas generators, propellants and infrared luminophores for aircraft decoy flares.

A typical pyrotechnic composition for such applications is a mix comprising magnesium, poly(tetrafluoroethylene) (PTFE, Teflon®) and vinylidene fluoride-hexafluoroisoprene copolymer (Viton®), also referred to as MTV. The use of the system magnesium/PTFE is based on the highly exothermal nature of the reaction of magnesium with PTFE according to the following equation:

$$m\ \mathrm{Mg}+(\text{—}C_2F_4\text{—})_n \rightarrow 2n\ \mathrm{MgF_2}+(m-2n)\mathrm{Mg}+2n\mathrm{C}+h\cdot\nu \quad (1)$$

In addition, an after-combustion of the carbon and also of excess magnesium occurs in the presence of atmospheric oxygen according to:

$$\mathrm{C}+\mathrm{O_2}\rightarrow\mathrm{CO_2}+h\cdot\nu \quad (2)$$

$$2\mathrm{Mg}+\mathrm{O_2}\rightarrow 2\mathrm{MgO}+h\nu \quad (3)$$

Important performance parameters of magnesium/PTFE mixtures are the mass-specific enthalpy of reaction, $kJ\cdot g^{-1}$, and the mass conversion, $g\cdot s^{-1}\cdot cm^{-2}$. These parameters are determined by the proportion of magnesium in the system, the geometric parameters of components used, e.g. particle size, particle shape, specific surface area, and also the metal content of the magnesium used. The processing techniques (pressing, extrusion, casting, etc.) also have a substantial influence on the burning behaviour and thus the performance of Mg/PTFE mixtures.

In addition, oxidative degradation of the magnesium occurs during storage of Mg/PTFE as a result of the action of water vapour and oxygen, and this can lead to a reduction in the performance; C. van Driel, J. Leenders, J. Meulenbrugge, Ageing of MTV, 26$^{th}$ Int. Conference of ICT, Jul. 4-7, 1995, V31, Karlsruhe. The performance of Mg/PTFE mixtures is also closely related to the way in which the process is carried out and this thus controls the reproducibility of the performance of the system; L. Sotsky, K. Jasinkiewicz, Twin Screw Mixing/Extrusion of M206 Infrared (IR) Decoy Flare Composition, 33$^{rd}$ Int. Conference of ICT, Jun. 25-28, 2002, V35.

For this reason, there is a need for a replacement for Mg/PTFE mixtures for the abovementioned applications, which retains or even improves the specific performance features and leads to better reproducibility of the performance properties and to an increased storage stability of the material under typical storage conditions.

It is therefore an object of the present invention to provide an energy-producing material which displays a high stability and a high reproducibility of the performance and at the same time has at least the performance of the Mg/PTFE system.

This object is achieved by an energy-producing material having the features of claim 1. Preferred embodiments and developments of the energy-producing material of the invention are subject matter of the dependent claims.

The energy-producing material of the invention is a chemically uniform polymer material. This polymer is made up of alternating monomer units having electron donor and electron acceptor properties, with the stoichiometric ratio of electron donor to electron acceptor being $\leqq 1$. This energy-producing material is, since it is chemically uniform, able to be monitored and controlled in respect of its physical and chemical properties more readily than conventional multicomponent systems, for example Mg/PTFE mixtures.

The monomer which functions as electron donor ($M_m$) is preferably an electropositive metal such as lithium, magnesium, calcium, strontium, barium, titanium, zirconium, zinc, aluminium, boron or silicon. The monomer which functions as electron acceptor is preferably a group of the general composition $Y_aX_b$ in which a strongly electronegative element X such as fluorine, chlorine or oxygen is bound to a less electronegative nonmetal Y such as carbon, nitrogen, sulphur or phosphorus. A typical polymer unit therefore has the following structure

. . . —M—Y(X)—M—Y(X)—M— . . . )

In a preferred embodiment of the invention, the energy-producing material is a polymer comprising perfluoroalkyl and magnesium units and having the formula $(\text{—}(CF_2)_c\text{—}Mg_d\text{—})_n$, where $c \leqq d$. The chemically uniform polymer material is preferably a dimagnesium derivative, d=2, c=1, of the formula $(\text{—}(CF_2)\text{—}Mg\text{—}Mg\text{—})_n$.

The energy-producing material of the present invention can be used in a variety of ways in both civil and military applications, for example as igniter for gas generators, as component of propellants, as energy carrier in rocket engines, as infrared luminophore for aircraft decoy flares and the like.

The abovementioned invention is based on the considerations mentioned below.

According to the invention, a replacement for Mg/PTFE mixtures which retains the specific performance features and displays better reproducibility of the performance and increased stability of the material under typical storage conditions is to be provided.

Compounds formed by reaction of metallic magnesium with organohalogen compounds have been known for a long time. These substances which are formed by insertion of magnesium into the carbon-halogen bonds of an organohalogen (1) according to equation (4) below are also named Grignard compounds (2) after their discoverer:

$$\underset{(1)}{\mathrm{Mg}} + \mathrm{R\text{—}X} \xrightarrow{\text{ether}} \underset{(2)}{\mathrm{R\text{—}Mg\text{—}X}} \quad (4)$$

where R=alkyl, alkenyl, alkynyl or aryl, and

X=Cl, Br or I, but not F.

C h. Elschenbroich, A. Salzer, Organometallchemie, 3rd ed., Teubner Verlag, Stuttgart, 1990, p. 55.

These compounds (2) can then undergo a series of subsequent reactions which are of great interest for preparative organic chemistry. However, one of the undesirable secondary reactions is the dismutation of compounds of the type (2) to form dialkylmagnesium compounds (3) according to:

$$\underset{(2)}{\mathrm{R\text{—}Mg\text{—}X}} \xrightarrow[(3)]{\text{hexane, dioxane}} \underset{(4)}{\mathrm{R\text{—}Mg\text{—}R}} + \mathrm{MgX_2}\downarrow$$

This reaction always occurs when the respective magnesium halide (4) is insoluble in the solvent used (e.g. hydrocarbons such as hexane or ether, for example 1,4-dioxane) and the concentration of the Grignard compound (2) in the solvent is very high.

Furthermore, when bifunctional Grignard reagents of the type (5) are used, either cyclo(alkyl)magnesium compounds (6) when the carbon chain is sufficiently long (n≧4) or poly (alkyl)magnesium compounds (7) can be formed in an analogous way:

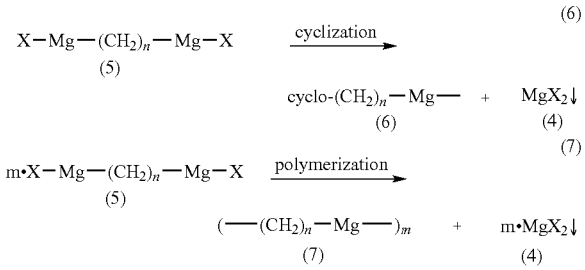

(6)

(7)

Both the cyclo(alkyl)magnesium compounds and the poly (alkyl)magnesium compounds (6) and (7) have only limited stability in air and can be decomposed by the action of water.

It is known that the stability of organometallic compounds to attack by other substances and also in respect of thermally induced decomposition can be improved by the introduction of fluorine as substituent on the carbon skeleton. The higher thermal and chemical stability of fluorinated RF compared to hydrogenated hydrocarbon skeletons RH can be attributed to the higher bond energy between metal and organyl radical in the case of fluorine substituents.

C h. Elschenbroich, A. Salzer, Organometallchemie, 3rd ed., Teubner Verlag, Stuttgart, 1990, p. 246.

Grignard compounds having fluorinated organyl radicals are thus more stable and easier to handle than their unfluorinated analogues; S. S. Dua, R. D. Howells, H. Gilman, Some Perfluoroalkyl Grignard Reagents and their Derivatives, *J. Fluorine Chem.* 4 (1974), 409-413.

As a consequence, the corresponding polymers of the type (8) are also more stable than the unfluorinated derivatives of the type (7).

With regard to the abovementioned requirements which a chemically uniform material has to meet as a replacement for Mg/PTFE mixtures, polymeric perfluoroalkylmagnesium compounds of the type (8) of the following formula can fill this gap:

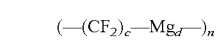

(8)

For the use of these polymers (8), the stoichiometric ratio of magnesium (as electron donor) to fluorine (as electron acceptor) should be not more than 1 (≦1), so that complete elimination of $MgF_2$ can occur on thermal stressing of the polymer (8). Ideally, magnesium is present in excess, which would promote after-combustion in the atmosphere for use as infrared luminophores. The decomposition of compounds of the type (8) can be assumed to be as follows:

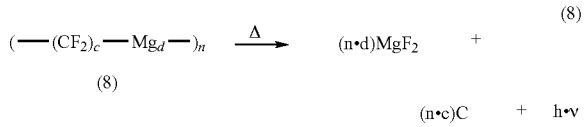

(8)

In the case of the dimagnesium derivative (9), 1 mol of Mg would in each case be left over for after-combustion in the atmosphere:

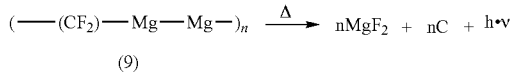

(9)

This would correspond to a stoichiometry in a heterogeneously composed conventional magnesium/Teflon mix with a magnesium content of 48%, which corresponds, for example, to fuel-rich mixes for infrared luminophores.

A possible synthesis of the stated compounds of the type (8) and (9) is indicated below for the example of poly(difluoroethenediyl)dimagnesium.

In a first step, the commercially available starting compound 1,2-dibromotetrafluoroethane (10) is reacted with magnesium at room temperature (RT) in tetrahydrofuran (THF) ($C_4H_8O$) (11) using a method based on the reference M. R. Smith Jr., H. Gilman, Preparation of α,ω-bis(dimethylhydrosilyl)perfluorohexane, *J. Organomet Chem.* 46 (1972), 251-254, to form the Grignard compound 1,1,2,2-tetrafluoro-1,2-bis(magnesium bromide) (12) according to equation (10):

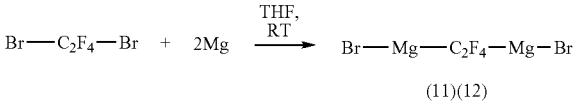

(10)

The Grignard compound (12) is then reacted in the presence of an equimolar amount of magnesium in THF to form the substituted Grignard compound (13) according to the equation (11):

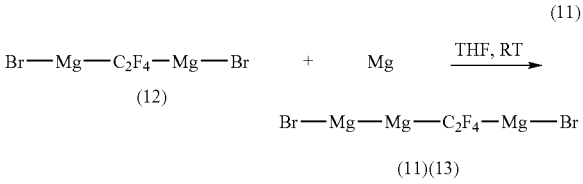

(11)

The THF solution of the Grignard compound (13) is then admixed with a relatively high-boiling hydrocarbon (e.g. petroleum spirit (14)) and the THF (11) is distilled off, resulting in polymerization of the Grignard compound (13) to form the desired polymer (15) and precipitation of the magnesium bromide (4a) which is insoluble in the hydrocarbon:

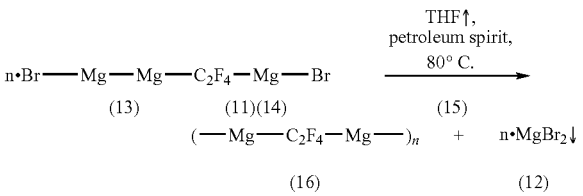

(12)

The polymer (15) can then be brought into any desired form from the solution without problems.

The invention claimed is:

1. An energy-producing material comprising a chemically uniform polymer material whose monomer units contain an electron donor and an electron acceptor, wherein the chemically uniform polymer material is a polymeric perfluoroalkylmagnesium compound of the formula $(—(CF_2)_c—Mg_d—)_n$ where c is less than or equal to d.

2. The energy-producing material according to claim 1, wherein the chemically uniform polymer material is a dimagnesium derivative of the polymeric perfluoroalkylmagnesium compound of the formula $$(—(CF_2)—Mg—Mg—)_n.$$

* * * * *